US008353991B2

(12) United States Patent
Jerg et al.

(10) Patent No.: US 8,353,991 B2
(45) Date of Patent: Jan. 15, 2013

(54) TEMPERATURE DETECTION DURING ZEOLITE DRYING

(75) Inventors: Helmut Jerg, Giengen (DE); Kai Paintner, Adelsried (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 751 days.

(21) Appl. No.: 12/531,506

(22) PCT Filed: Apr. 3, 2008

(86) PCT No.: PCT/EP2008/054041

§ 371 (c)(1),
(2), (4) Date: Sep. 16, 2009

(87) PCT Pub. No.: WO2008/125517

PCT Pub. Date: Oct. 23, 2008

(65) Prior Publication Data

US 2010/0101613 A1 Apr. 29, 2010

(30) Foreign Application Priority Data

Apr. 12, 2007 (DE) ..... 10 2007 017 284

(51) Int. Cl.
*B08B 3/00* (2006.01)

(52) U.S. Cl. ..... 134/56 D

(58) Field of Classification Search ..... 134/56 D
See application file for complete search history.

(56) References Cited

U.S. PATENT DOCUMENTS

| | | | | |
|---|---|---|---|---|
| 4,291,543 | A * | 9/1981 | Alluto | 62/158 |
| 2004/0200508 | A1 * | 10/2004 | Jung et al. | 134/25.2 |
| 2008/0149142 | A1 | 6/2008 | Jerg et al. | |

FOREIGN PATENT DOCUMENTS

| | | | |
|---|---|---|---|
| DE | 10210842 | A1 | 9/2003 |
| JP | 2006-20754 | A | 1/2006 |
| WO | 9833427 | | 8/1988 |
| WO | 2005053504 | A1 | 6/2005 |

OTHER PUBLICATIONS

Ishii, Takahito, Jul. 2004, JP 2006-020754, English machine translation.*

Ishii, Takahito, Jan. 2006, JP 2006-020754, English machine translation.*

* cited by examiner

*Primary Examiner* — Michael Barr
*Assistant Examiner* — Jason Ko
(74) *Attorney, Agent, or Firm* — James E. Howard; Andre Pallapies

(57) ABSTRACT

A dishwashing machine is provided having a washing compartment, a drying unit that includes an absorption column with a reversibly dehydratable drying agent, and having an air circulation loop through the washing compartment and the drying unit. A temperature sensor is arranged in front of the drying unit and to the rear of the washing compartment with respect to the direction of the flow of air circulating in the air circulation loop.

8 Claims, 2 Drawing Sheets

TEMPERATURE DETECTION DURING ZEOLITE DRYING

BACKGROUND OF THE INVENTION

The invention relates to a dishwashing machine with a washing compartment and a drying unit, comprising an absorption column with a drying agent which can be reversibly dehydrated, with an air circulation loop through the washing compartment and the drying unit and with temperature detection of the circulating air. The invention further relates to a drying method for dishwashing machines with a drying unit and an air circulation loop between said drying unit and the washing compartment, in which a temperature profile of the circulating air is recorded and the drying is terminated upon a predefined value being reached.

Dishwashing machines with a drying unit can have a drying agent which can be reversibly dehydrated as water-absorbing material. They make use of the characteristic of the zeolite whereby heat is emitted upon the absorption of water as a consequence of the absorption reaction. The more water the zeolite absorbs, the higher its temperature rises. This fact can be used to detect the moisture content in the air circulation loop of the dishwashing machine and thus the degree of drying of the crockery. Control of the drying process, which is based on the detection of the temperature and thus indirectly on the humidity of the air, is considerably more precise than time-based control, as it is oriented toward the actual drying conditions in the dishwashing machine. These can, for example, fluctuate sharply as a result of loads of different weight or density in the dishwashing machine. Sequential control of this kind is, for example, described in DE 10 2005 004 097 A1. It is further known from DE 10 2005 004 097 A1 for the temperature to be detected as close as possible to the heat source, that is downstream of the absorption column or in the water-absorbing material itself. The high temperatures prevailing there do, however, call for specially designed, more expensive temperature sensors.

BRIEF SUMMARY OF THE INVENTION

It is the object of the present invention to further simplify control in particular for drying in a dishwashing machine of this kind.

In an exemplary embodiment of the invention a temperature sensor is arranged upstream of the drying unit and downstream of the washing compartment in the direction of flow of the air circulating in the air circulation loop. The invention differs from other devices in that it, diverges from detection of the temperature in the zeolite or downstream of the absorption column and instead detects it previously. To this end it makes use of a closed air circulation loop that exists in the dishwashing machine, which is not subject to significant temperature loss. In addition it is not necessary for control of the drying unit to detect an absolute temperature that is actually obtained. It is sufficient only to detect a significant temperature change in the air circulation loop, according to an exemplary embodiment of the invention. The temperature change can also be recorded upstream of the absorption column, where lower temperatures prevail. This enables the use of simpler, cost-effective standard components as temperature sensors.

Different temperature sensors can in principle be used for the temperature level obtaining upstream of the absorption column. According to an advantageous embodiment of the invention, a temperature sensor in the air circulation loop can be used for detecting the temperature of the circulating air.

The temperature sensor can take the form of an ultra-low-cost standard component, e.g. a PTC or an NTC resistor with a non-linear characteristic curve, whose assembly and integration into the controller do not give rise to difficulties. Alternatively, any other suitable temperature sensor can be employed, such as for example linear temperature-dependent resistors or peltier elements.

Dishwashing machines with zeolite drying generally have a fan for maintaining the airflow from the washing compartment into the absorption column and back. They can additionally have an auxiliary heater, to the extent that, for example, the heat output from the absorption column is insufficient. According to a further advantageous embodiment of the invention a temperature sensor—for simplicity's sake hereinafter referred to as an "NTC resistor"—is arranged downstream of the fan and if applicable upstream of a heater. Here too a relatively low temperature level prevails, so that a cost-effective NTC resistor can be employed as a standard component, and the air temperature in the washing compartment can thus be indirectly measured.

According to a further advantageous embodiment of the invention an additional NTC resistor can also be arranged in the dishwasher interior, in order to detect the temperature there immediately. As a standard component, neither does an NTC resistor here represent a significant cost factor, so that its use does not markedly increase the cost of manufacturing the dishwashing machine.

According to a further advantageous embodiment of the invention at least one temperature sensor can interact with a control unit for fault location purposes, and the temperature sensor preferably interact with a control unit to control the drying. If the fan should fail, a significant temperature rise thus occurs due to a lack of cooling airflow at the NTC resistor. Conversely, the NTC resistor can detect a fall in temperature, if the heater should stop functioning. The corresponding signal of the NTC resistor can then be processed in a control unit as a fault signal.

According to a further advantageous embodiment of the invention, an NTC resistor can serve both for control of the drying and for fault detection. The NTC resistor can here be arranged both in the dishwasher interior and upstream or downstream of the fan as well as upstream of a heater if appropriate, but in any case upstream of the absorption column. Thanks to the multiple function of the same NTC resistor, savings on assembly and costs can be achieved.

The stated object is further achieved in the drying method according to the invention mentioned in the introduction in that the temperature of the air circulating in the air circulation loop is detected upstream of the drying unit and downstream of the washing compartment. As already explained, more reasonably priced standard components can be used with otherwise unchanged control methods as a result of the lower temperature levels obtaining there.

According to an advantageous embodiment of the method, different degrees of drying can be assigned to discrete sections of the temperature profile. They can be used for the definition of a possible premature end of the drying process. Different drying results can thereby be achieved and the user offered additional selection options.

The temperature profiles of different drying processes all have a characteristic profile. This differs only minimally from those belonging to others. According to a further advantageous embodiment of the inventive method, variances in the temperature profile can be analyzed for fault control purposes. Thus if significant variances from the characteristic temperature profile arise, malfunctioning of the fan, for example, can be assumed. It can be processed into a fault message by a controller of the dishwashing machine.

The temperature profiles of the remaining washing procedures can also be detected and monitored according to the same principle. A fall in temperature during rinsing with rinse-aid can, for example, indicate the failure of an auxiliary heater, with which the air and with it the washing liquor can be additionally heated. An increase during the rinsing with rinse-aid on the other hand can likewise stem from the failure of the fan.

The temperature profiles of the remaining washing procedures can also be detected and monitored according to the same principle. A fall in temperature during rinsing with rinse-aid can, for example, indicate the failure of an auxiliary heater, with which the air and with it the washing liquor can be additionally heated. An increase in temperature during the rinsing with rinse-aid on the other hand can likewise stem from the failure of a fan.

BRIEF DESCRIPTION OF THE DRAWINGS

The principle of the invention is further explained below on the basis of a drawing used by way of example. Wherein.

DETAILED DESCRIPTION OF EXEMPLARY EMBODIMENTS OF THE PRESENT INVENTION

Figure 1:
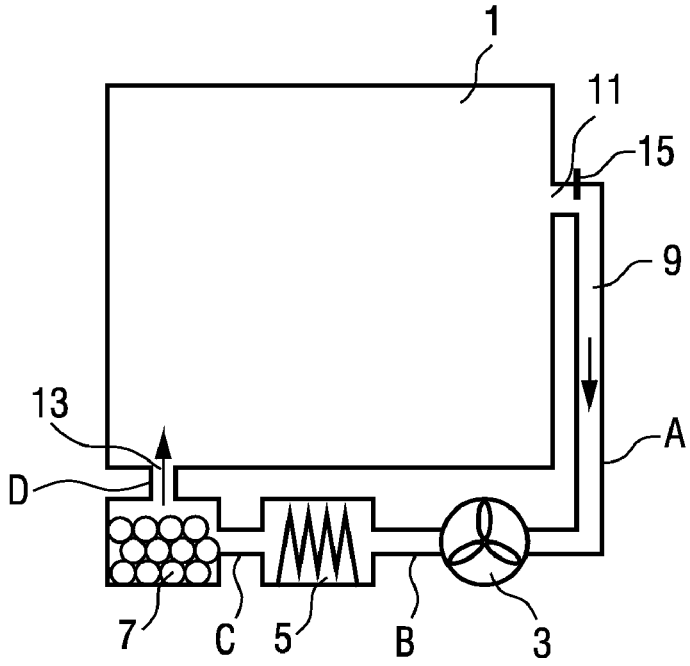
FIG. 1: shows in schematic form the structure of a dishwashing machine with a temperature sensor in the air circulation loop.
Figure 2:
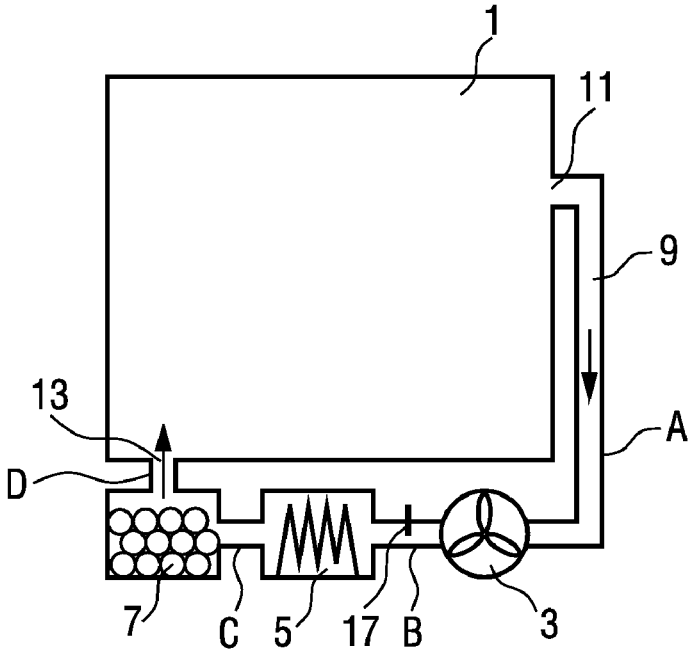
FIG. 2: shows a further structure with an alternative arrangement of the temperature sensor.

FIGS. 1 and 2 show, in principle, the units of a dishwashing machine relevant to the invention. Accordingly, it comprises a washing compartment 1, in which are arranged a fan 3, an auxiliary heater 5 and a drying unit 7 with an absorption column 19, where a drying agent 21 which can be reversibly dehydrated is present in the absorption column 19. They are successively flowed through by air, which is transported via an air line 9 which connects them in an air circulation loop (represented by arrows). The air line 9 branches off from the washing compartment 1 at an intake 11 and initially leads to the fan 3. Its section upstream of the fan 3 is identified with A. Section B of the air line 9 extends downstream of the fan 3 and upstream of the auxiliary heater 5. Its section C runs downstream of the auxiliary heater 5 and upstream of the absorption column while section D of air line 9 extends downstream of the absorption column as far as an air-injection port 13 into the washing compartment 1.

A temperature sensor according to the prior art has previously been arranged either in the absorption column 7 itself or downstream, that is between the absorption column 7 and the air-injection port 13 in section D of the air line 9. Because of the high temperatures occurring upon water absorption in the absorption column 7 the temperature sensor too had to be embodied accordingly thereupon.

Figure 3:
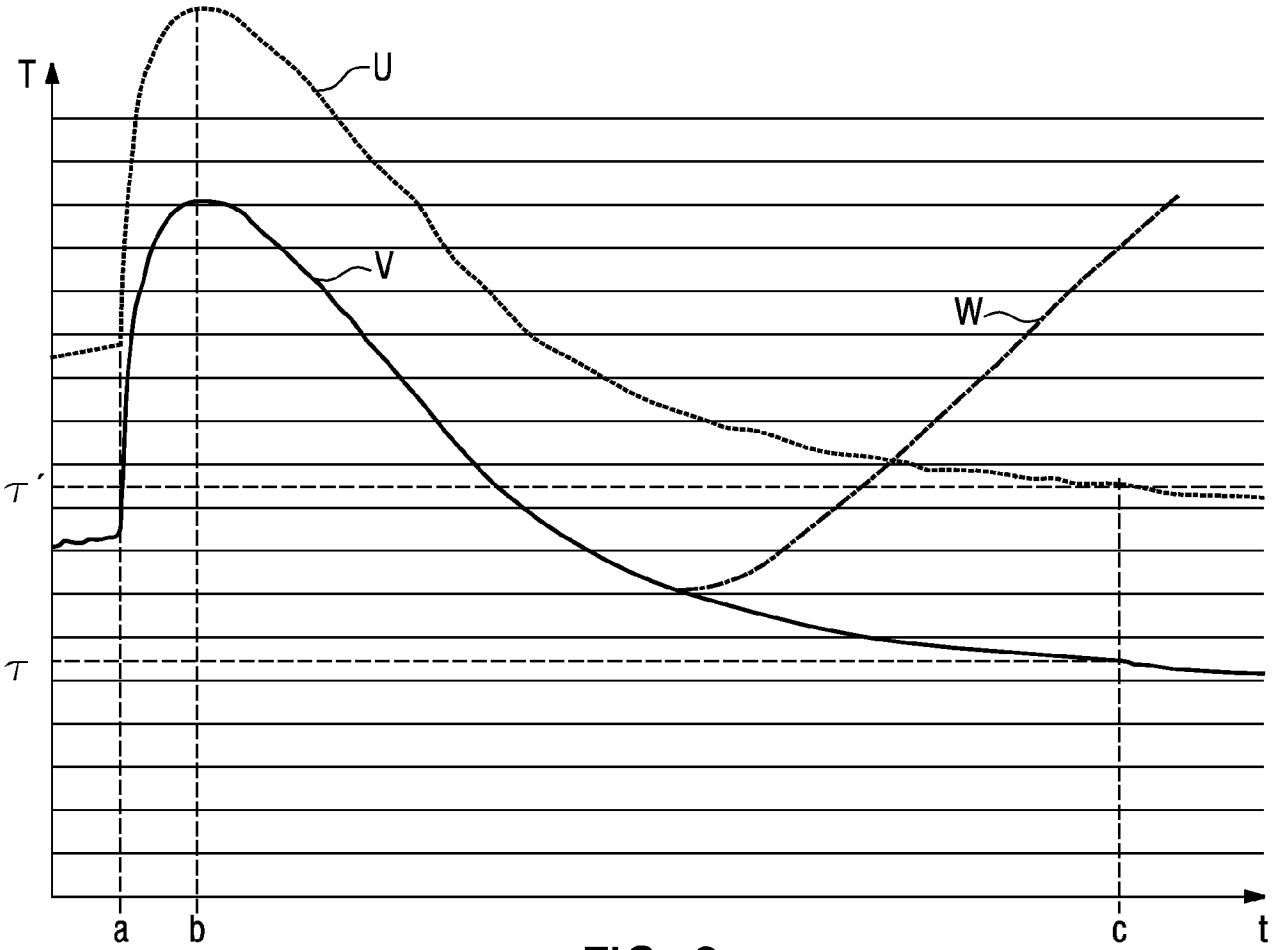
FIG. 3: shows characteristic temperature profiles of drying processes.

An exemplary temperature profile, recorded there by a temperature sensor of this kind, is reproduced in FIG. 3 as curve U. It runs in a coordinate system with time t as the abscissa and temperature T as the ordinate. At the start of the drying, at point in time a, it initially rises sharply, until reaching an apex after a relatively short period at point in time b and moves toward a characteristic temperature $\tau'$, initially falling steeply and later with a shallower gradient. At this temperature, the items being washed can be assumed to be completely dry. Upon temperature $\tau'$ being reached at point in time c the drying process is thus completed.

According to the invention an NTC resistor 15 is now arranged as a temperature sensor in section A of the air line 9 immediately downstream of intake 11. The temperature of the air measured there is already considerably cooler than upon entry into the washing compartment 1, because on the one hand it has given off energy to the items being washed and on the other hand has absorbed moisture from the dishwasher interior during the drying process. In FIG. 3 this shows the curve V, which moves toward the lower characteristic temperature $\tau'$. Thanks to the lower temperature levels obtaining at the intake 11, a simple NTC resistor can be used, which as a standard component does not represent a significant cost factor. Arranged at the intake 11 is located the NTC resistor 15, which is furthermore in a mechanically protected area, so that it cannot easily be accidentally damaged as a result of inexpert operation, for example when loading the dishwashing machine. At the same time, however, it very effectively detects the average temperatures actually prevailing in the washing compartment 1, as the entire air contents of the washing compartment 1 are directed through the intake 11 and thus past it.

An exemplary temperature profile of the NTC resistor 15 is shown in FIG. 3 as curve V. In principle it demonstrates the same characteristic profile as the curve U determined according to the prior art. The only difference compared with the prior art lies in its being shifted downwards parallel to and in the direction of the ordinate, from which the lower temperature level at the location of the NTC resistor 15 can be recognized.

According to the invention an NTC resistor 15 is now arranged as a temperature sensor in section A of the air line 9 immediately downstream of intake 11. The temperature of the air measured there is already considerably cooler than upon entry into the washing compartment 1, because on the one hand it has given off energy to the items being washed and on the other hand has absorbed moisture from the dishwasher interior during the drying process. In FIG. 3 this shows the curve V, which moves toward the lower characteristic temperature T. Thanks to the lower temperature levels occurring at the intake 11, a simple NTC resistor can be used, which as a standard component does not represent a significant cost factor. Arranged at the intake 11 is located the NTC resistor 15, which is furthermore in a mechanically protected area, so that it cannot easily be accidentally damaged as a result of inexpert operation, for example when loading the dishwashing machine. At the same time, however, it very effectively detects the average temperatures actually prevailing in the washing compartment 1, as the entire air contents of the washing compartment 1 are directed through the intake 11 and thus past it.

If the auxiliary heater 5 malfunctions, the temperature level falls and thus diverges increasingly from the characteristic temperature profile. This primarily affects the rinsing with rinse-aid phase, which is not shown in FIG. 3.

The NTC resistor 17 can nevertheless also be used for functional monitoring of the fan 3, as it detects the temperature directly downstream of the fan and upstream of the two heat sources, the auxiliary heater 5 or the absorption column 7 respectively. When the fan is operating, the cooled air thus flows from the washing compartment 1 past the NTC resistor 17, and reaches the auxiliary heater 5 or absorption column 7 respectively, in which it is heated once again. If, however, the fan 3 fails, so the circulation in the air line 9 and through the washing compartment 1 comes to a halt. The absorption column 7 continues to radiate heat however. Due to lack of air flow at the NTC resistor 17 and as a result of the progressive heating of the now stationary air, the temperature at the NTC resistor 17 also rises. An exemplary profile for this is shown in FIG. 3 as curve W. The divergence from the characteristic profile of curve V is detected by the control unit and processed into a fault message for the area of the air circulation loop.

List of Reference Characters

1 Washing compartment
3 Fan
5 Heater
7 Drying unit
9 Air line
11 Intake
13 Air-injection port
15, 17 NTC resistor
19 Absorption column
21 Drying agent
A, B, C, D: Sections of the air line 9
U: Temperature profile according to the prior art
V: Temperature profile according to the invention
W: Divergent temperature profile in the case of a malfunction
a: Point in time for the start of drying
b: Point in time for attainment maximum temperature
c: Point in time for the end of drying
$\tau$, $\tau'$: Characteristic temperature

The invention claimed is:

1. A dishwashing machine comprising:

a washing compartment;

a drying unit, the drying unit having an absorption column with a drying agent configured for reversible dehydration;

an air circulation loop through the washing compartment and the drying unit along which air is circulated;

a temperature sensor, the temperature sensor being located upstream of the drying unit and downstream of the washing compartment relative to the direction of flow of air circulating in the air circulation loop; and a control unit configured to receive temperature signals from the temperature sensor and, based on the received temperature signals, to both detect faults within the dishwashing machine and to control a drying time of the drying unit.

2. The dishwashing machine as claimed in 1, wherein the temperature sensor has an NTC resistor.

3. The dishwashing machine as claimed in claim 1 and further comprising a heater for heating circulating air, and wherein the temperature sensor is located upstream of the heater.

4. The dishwashing machine as claimed in claim 1 and further comprising a fan for generation of an airflow in the air circulation loop, and wherein the temperature sensor is arranged downstream of the fan.

5. The dishwashing machine as claimed in claim 1, further comprising a second temperature sensor located in the washing compartment.

6. The dishwashing machine as claimed in claim 1, wherein a detected fault comprises at least one of a malfunctioning auxiliary heater and a malfunctioning fan.

7. The dishwashing machine as claimed in claim 6, wherein the detected fault is detected by the control unit during a rinsing stage of operation of the dishwashing machine.

8. A method for operating a dishwashing machine, comprising:

circulating air through a gaseous circulation loop from a washing compartment, through a drying unit with an absorption column, and back to the washing compartment;

sensing a temperature with a temperature sensor, the temperature sensor being located upstream of the drying unit and downstream of the washing compartment relative to the direction of gaseous circulation;

detecting faults with a control unit, based on the sensed temperature, within the dishwashing machine; and controlling a drying time, also based on the sensed temperature, of the drying unit with the control unit configured to receive the sensed temperature from the temperature sensor.

* * * * *